US008409010B2

(12) United States Patent
Clowes et al.

(10) Patent No.: US 8,409,010 B2
(45) Date of Patent: Apr. 2, 2013

(54) MASSIVELY MULTIPLAYER GAME WITH SHARED GAMEPLAY EXPERIENCE

(75) Inventors: Joanne Clowes, Redmond, WA (US); Brett Johnson, Redmond, WA (US)

(73) Assignee: Microsoft Corporation, Redmond, WA (US)

( * ) Notice: Subject to any disclaimer, the term of this patent is extended or adjusted under 35 U.S.C. 154(b) by 558 days.

(21) Appl. No.: 12/553,003

(22) Filed: Sep. 2, 2009

(65) Prior Publication Data

US 2010/0285858 A1 Nov. 11, 2010

Related U.S. Application Data

(60) Provisional application No. 61/175,732, filed on May 5, 2009.

(51) Int. Cl.
*A63F 9/24* (2006.01)

(52) U.S. Cl. ..... 463/42; 463/9

(58) Field of Classification Search ..... 463/9, 25, 463/40–43

See application file for complete search history.

(56) References Cited

U.S. PATENT DOCUMENTS

| | | | | |
|---|---|---|---|---|
| 5,695,400 | A * | 12/1997 | Fennell et al. | 463/42 |
| 5,779,549 | A * | 7/1998 | Walker et al. | 463/42 |
| 6,193,610 | B1 * | 2/2001 | Junkin | 463/40 |
| 6,227,974 | B1 * | 5/2001 | Eilat et al. | 463/40 |
| 6,241,612 | B1 | 6/2001 | Heredia | |
| 6,409,599 | B1 * | 6/2002 | Sprout et al. | 463/31 |
| 6,579,184 | B1 | 6/2003 | Tanskanen | |
| 7,353,274 | B1 * | 4/2008 | Rouhi et al. | 709/225 |
| 7,458,894 | B2 * | 12/2008 | Danieli et al. | 463/42 |
| 8,105,149 | B2 * | 1/2012 | DeWaal | 463/20 |
| 2002/0042293 | A1 * | 4/2002 | Ubale et al. | 463/9 |
| 2002/0065802 | A1 | 5/2002 | Uchiyama | |
| 2002/0187834 | A1 | 12/2002 | Rowe et al. | |
| 2003/0033157 | A1 * | 2/2003 | Dempski et al. | 705/1 |
| 2004/0102235 | A1 | 5/2004 | Berman | |
| 2006/0010256 | A1 | 1/2006 | Heron et al. | |
| 2006/0217201 | A1 | 9/2006 | Berstis et al. | |
| 2006/0258446 | A1 | 11/2006 | Nguyen et al. | |
| 2007/0087829 | A1 * | 4/2007 | Liu et al. | 463/42 |
| 2007/0173324 | A1 | 7/2007 | Multerer et al. | |
| 2007/0184902 | A1 * | 8/2007 | Liu et al. | 463/42 |
| 2007/0184903 | A1 * | 8/2007 | Liu et al. | 463/42 |
| 2007/0233291 | A1 * | 10/2007 | Herde et al. | 700/91 |
| 2007/0243936 | A1 * | 10/2007 | Binenstock et al. | 463/42 |
| 2007/0288969 | A1 * | 12/2007 | Prum | 725/81 |

(Continued)

OTHER PUBLICATIONS

"1 vs 100 Official Rules" published by NBC, available on or before Feb. 27, 2007 and retrieved from URL <http://web.archive.org/web/20070227024534/http://www.nbc.com/Casting/Applications/1v100_rules.pdf> on Apr. 10, 2012, 7 pages.*

(Continued)

*Primary Examiner* — Dmitry Suhol
*Assistant Examiner* — Jason Skaarup
(74) *Attorney, Agent, or Firm* — Alleman Hall McCoy Russell & Tuttle LLP

(57) ABSTRACT

According to some aspects of the present disclosure, a computing system for coordinating massively multiplayer games is provided. The computing system may include a data aggregation service to collect, aggregate and distribute game play data that is used by game code executed on each player's computing device to influence game flow of a shared game play experience for many thousands of remotely located players in real-time. Accordingly, game data from any player may impact and influence the game play experience of all other players. Further, each player's computing device may be event driven such that game data may be received from the game data aggregation service at a synchronized time to synchronize the shared game play experience for all players.

17 Claims, 4 Drawing Sheets

U.S. PATENT DOCUMENTS

| | | | | |
|---|---|---|---|---|
| 2008/0146342 | A1* | 6/2008 | Harvey et al. | 463/42 |
| 2008/0220854 | A1 | 9/2008 | Midgley et al. | |
| 2008/0274810 | A1 | 11/2008 | Hayashi et al. | |
| 2008/0287194 | A1 | 11/2008 | Lee et al. | |
| 2009/0023492 | A1 | 1/2009 | Erfanian | |
| 2009/0098940 | A1 | 4/2009 | Sangberg | |
| 2009/0286604 | A1* | 11/2009 | Clowes et al. | 463/42 |
| 2009/0325706 | A1* | 12/2009 | Geist et al. | 463/40 |
| 2010/0146544 | A1* | 6/2010 | Aoki et al. | 725/37 |
| 2010/0285885 | A1* | 11/2010 | Livni et al. | 463/42 |
| 2011/0264494 | A1* | 10/2011 | Lechowicz | 705/14.12 |

OTHER PUBLICATIONS

"E3 2008: 1 vs. 100 Impressions" written by Justin Calvert, published on Jul. 14, 2008, retrieved from URL <http://www.gamespot.com/1-vs-100-2009/previews/e3-2008-1-vs-100-impressions-6193769/> on Apr. 10, 2012, 6 pages.*

"1 vs 100 Review: Fear the CG Saget" written by Mike Pereira, published on Aug. 1, 2008, retrieved from URL <http://uk.ds.ign.com/articles/895/895850p1.html> on Apr. 16, 2012, 5 pages.*

"International Search Report", Mailed Date: Dec. 10, 2010, Application No. PCT/US2010/032225, Filed Date: Apr. 23, 2010, pp. 9.

Knutsson, et al., "Peer-to-Peer Support for Massively Multiplayer Games", retrieved at <<http://www.comp.nus.edu.sg/~bleong/hydra/related/knutsson04p2p.pdf>>, pp. 12.

Ferretti, Stefano, "Interactivity Maintenance for Event Synchronization in Massive Multiplayer Online Games", retrieved at <<http://www.cs.unibo.it/pub/TR/UBLCS/2005/2005-05.pdf>>, Technical Report UBLCS-2005-05, Mar. 2005, pp. 222.

Appelman, Robert L. "Experiential Modes of Game Play", retrieved at http://www.indiana.edu/~drbob/Presentations/Experiential%20Modes%20of%20Game%20Play_FINAL_share.doc>>, DiGRA Conference—Tokyo Japan, 2007, pp. 1-12.

State Intellectual Property Office of the People's Republic of China, Notice of the First Office Action of Chinese Patent Application No. 201080020931.8, Nov. 29, 2012, 13 pages.

* cited by examiner

MASSIVELY MULTIPLAYER GAME WITH SHARED GAMEPLAY EXPERIENCE

CROSS-REFERENCE TO RELATED APPLICATIONS

This application claims priority to U.S. Provisional Patent Application Ser. No. 61/175,732, entitled "MASSIVELY MULTIPLAYER GAME INCLUDING A SINGLE SHARED GAME PLAY EXPERIENCE," filed May 5, 2009, the disclosure of which is hereby incorporated by reference in its entirety and for all purposes.

BACKGROUND

In a massively multiplayer game that hosts a massive number of players at one time, typically the game play experience of the massively multiplayer game may be broken into different shards. In a shard of the massively multiplayer game, a player may experience only part of an entire setting of the massively multiplayer game. Further, the player may interact with only some of the other players of the massively multiplayer game that are also in the shard. Accordingly, actions taken by the player may only impact the game play experience of those players around the player. Since the massively multiplayer game has such a splintered game play experience that permits the player to only impact a few other players and experience only a part of the setting at one time, the player may be left feeling that the game is not implemented on a massive scale or does not have an epic feel. This may lead to the player losing interest and no longer playing the massively multiplayer game.

SUMMARY

According to some aspects of the present disclosure, a computing system for coordinating massively multiplayer games is provided. The computing system includes a network connection configured to enable two-way communication with a player group of at least thousands of remotely located computing devices. The computing system includes a logic subsystem configured to execute instructions, and a data-holding subsystem holding instructions executable by the logic subsystem to: send an event-driven request to answer a question to each remotely located computing device of the player group; receive answer responses to the event-driven request from at least some of the remotely located computing devices of the player group; aggregate received responses to the event-driven request; and synchronize game play to produce a game experience concurrently shared in real-time by all remotely located computing devices of the player group based on aggregated responses received from at least some of the remotely located computing devices of the player group, at a predetermined time, the game experience including a game view and game sounds representative of a virtual setting in which at least a featured group of players of the player group are virtually represented to all players of the player group.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The present disclosure is related to a massively multiplayer game in which a plurality of players concurrently share a single game play experience in real-time. More particularly, the present disclosure is related to a massively multiplayer game having game flow mechanics that enable actions or events relating to any one player to impact and/or influence game play of all other players in the game. Each player plays the game using a network computing device that can communicate with a game server and/or directly with the network computing devices of other game players. The various network computing devices may be remotely located relative to one another, thus allowing players from diverse geographical locations to concurrently participate in the same game. As is explained in more detail below, to provide a shared game experience for such a massive number of players, a server computing system runs a data aggregation service to collect and aggregate game data according to an event-driven schedule, and then distribute game data to the massive number of player clients on the event-driven schedule. Each of the massive number of game clients is configured to be event driven at massive scale so that all game players are kept in synch and playing a single shared experience.

In this genre of mass participation gaming, many players may be placed in a single game session hosted by the game server. The game server allows each player to share the same game play experience as other players in real-time. In some embodiments, each player in the game session may be presented with a game view and game sounds that share the same virtual elements at the same time as all other game players. For example, a virtual avatar of a featured player may be presented in the game view of all players playing the game. In other embodiments, different game players may be presented with different views and/or sounds depending on where that player's character is virtually located within the game world.

Figure 1:
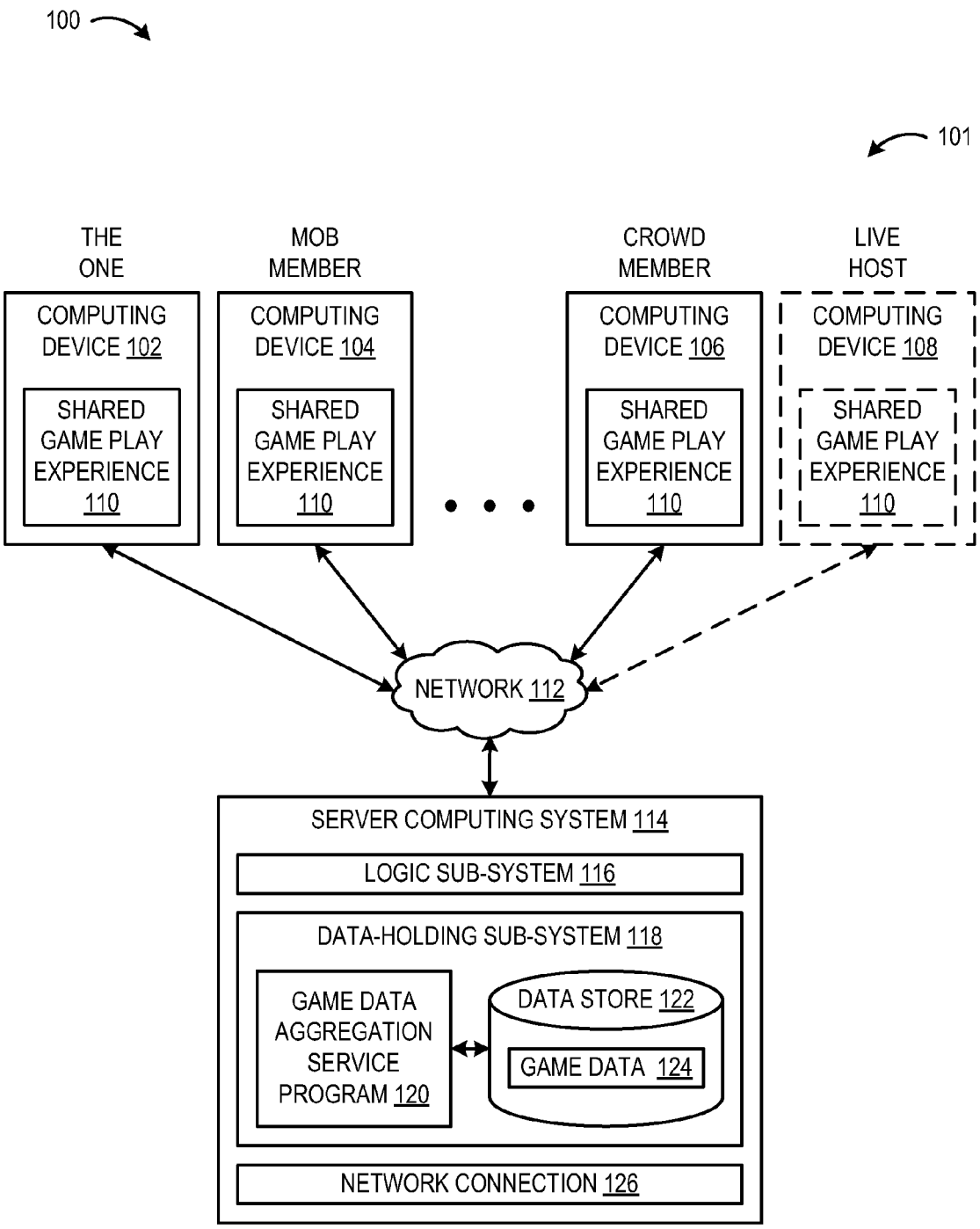
FIG. 1 is a schematic diagram of an embodiment of a computing system in which a massively multiplayer game may be implemented.

FIG. 1 is a schematic diagram of an example computing system 100 in which a massively multiplayer game may be implemented. The computing system may include a plurality of network computing devices 101 that each may be configured to locally execute the massively multiplayer game based on game data that is received from a game data aggregation service program 120. The plurality of network computing devices 101 may comprise the total group of players that play the massively multiplayer game. It is to be understood that each of the plurality of network computing devices 101 may join the game via a network 112, and thus each computing device may be remotely located relative to game data aggregation service program 120 and/or other computing devices.

The game data aggregation service program 120 may be configured to communicate with each of the plurality of network computing devices 101 via network 112. For purposes of simplicity network links only connecting the computing devices (102, 104, 106, 108) of different types of participants in the massively multiplayer game are shown, although it will be appreciated that each computing device of all participants in the game may be linked to game data aggregation service program 120. The network 112 may be virtually any suitable network or collection of different networks that facilitate communication between computing devices and/or game servers. For example, network 112 may comprise a wide area network (WAN), such as the Internet.

The game data aggregation service program 120 may include instructions held in a data-holding sub-system 118 of a server computing system 114 that is in communication with network 112 via network connection 126. The network connection 126 may be configured to enable two-way communication between server computing system 114 and any of the networked computing devices 101. The game data aggregation service program 120 may be executed by a logic sub-system 116 of server computing system 114. The game data aggregation service program 120 may be configured to manage game flow of the massively multiplayer game so that the computing device of each participant receives game data that results in a game play experience 110 that is concurrently shared in real-time by all players in a game session of the massively multiplayer game.

The shared game play experience 110 may include a game view and game sounds representative of a virtual setting in which the players of the game session are virtually represented. The game data aggregation service program 120 may be configured to collect, aggregate, and distribute game play data that is used by game code to influence the game flow for many thousands of players in real-time. The game data aggregation service program 120 may be in communication with a data store 122 held by data-holding sub-system 118. The data store 122 may be configured to organize game data 124 aggregated from the plurality of network computing devices 101 by game data aggregation service program 120. The game data 124 may include answer data provided by at least some of the players during a game round. In some embodiments, the data store 122 may take the form of a game space. The game space may include storage spaces or virtual buckets in which game data is aggregated to and/or held. For example, a game space may hold a first selectable answer to a question. Correspondingly, a computing device of a player may request that game space location in order to find out how many players selected the first selectable answer to the question. In some cases, a game space location may comprise game data generated from a message received from a computing device.

In some embodiments, each of the plurality of network computing devices 101 may be configured to be event driven at a massive scale to keep all game players in sync to maintain a single shared game play experience 110. In particular, game data aggregation service program 120 may be configured to send event-driven requests to each of the network computing devices. At least some of the plurality of network computing devices 101 may report answers to the request as well as status and/or variables to game data aggregation service program 120, which may receive the answers and aggregate the answers to form game data 124 and use such data to impact or influence the shared game play experience 110. Further, game logic at each computing device may schedule the get of this data from the service and integrate it into the game flow for all game players at a synchronized point in time. Upon receiving the aggregated game data, it is used to synchronize game play to produce a game experience concurrently shared in real-time by network computing devices 101. Further, the aggregated game data may influence the game play experience for all players in a game session.

The present disclosure is broadly applicable, although the examples discussed herein are primarily directed to a multiplayer game that involves a massive number of participants (e.g., up to 200,000 participants or more) that share a single game play experience. Many of the examples used herein will be explained in terms of a massive-participation, round-based, trivia game such as the game 1 vs 100. However, the herein described game flow mechanics and/or game execution can be applied to a variety of different games without departing from the spirit of this disclosure.

In one implementation, 1 vs 100 may include a game mode where a game session is initiated and a round begins with assignment of one of a plurality of roles to each computing device from the player group. The role assignment may include selection of a featured player (i.e., "The One") for a role from a total group of players participating in the game session. In the illustrated embodiment, a player selected as The One may operate computing device 102. The One competes against a group of players (i.e., "The Mob") that is selected from the player group for another role to answer trivia questions in a round. In the illustrated embodiment, a player selected as a member of The Mob may operate computing device 104. In some cases, The One and The Mob may be referred to as featured players. The featured group of players may include all remotely located computing devices assigned to The One and The Mob. In some cases, the featured players are eligible to be awarded a prize at the beginning of a round of the trivia game. In this game mode, The One tries to eliminate The Mob members by answering questions correctly, while The Mob tries to outlast The One. As The Mob members are knocked out (by answering incorrectly) the prize type changes/level increases. The prize level may increase based on a number of players that select the correct answer to a trivia question or a number of players that select an incorrect answer to the trivia question. Further, The One may ask for help to get past difficult questions in a round.

In some implementations, The Mob comprises one hundred players. In some implementations, The One and the members of The Mob may be selected based on player statistics aggregated from previous game play. Selection of The One and The Mob may be based on, for example, a metric of statistics that includes an average speed at which a player answers a question, an accuracy of selected answers, and participation scoring. The metric may be derived differently from round to round with different weights being applied in each round. For example, The One and The Mob may be selected based on having the highest/best score according to the metric.

For each round of the game session, the player selected as The One as well as the players selected to be members of The Mob may be characterized as focus-players that may be involved in prize distribution and/or scoring of the game. For example, in a round of the game session, The One may compete against The Mob to be awarded a prize.

Furthermore, the group of players (i.e., "The Crowd") not selected as The One or as the members of The Mob from the total group of players may be assigned a third role and may selectively participate in the round and may affect the game play experience of all of the other players, under certain conditions. For each round of the game session, the players that act as members of The Crowd may be characterized as non-focus or non-featured players that may participate and influence game play. In other words, The Crowd may be characterized as a group of players that compete for prizes that are different than those that are awarded to The One and the members of The Mob. Through participation in the game, members of The Crowd may earn a score that may be used for role selection in future rounds and/or may be used to award a prize different from the prize for which The One and The Mob are competing. In the illustrated embodiment, a player selected as a member of The Crowd may operate computing device 106.

Once the players have been categorized into the three groups (i.e., The One, The Mob, The Crowd) for a round, a shared game play experience 110 may be presented to all players. The shared game play experience 110 may include a game view and game sounds representative of a virtual setting in which at least some players of the game session are virtually represented as avatars. For example, the featured group of players may be viewable in the game view of every player. As one particular example, an avatar of the player selected as The One may be shown at center stage. The game view may include a plurality of avatars of players selected as members of The Mob positioned on stage. Further, the game view may include a plurality of avatars of players selected as members of The Crowd that represent an arbitrary or predetermined selection of members of The Crowd seated in the audience.

In some embodiments, the game view for each player may include a host avatar in the virtual setting. In some implementations, the host avatar may be representative of a live host. In the illustrated embodiment, the live host may arbitrate the shared game play experience via computing device 108. In some implementations, the host avatar may be representative of an artificial host generated by the game. The host avatar may ask trivia questions to all players in order to drive game flow in a round. The host may also provide commentary, tell jokes, interview players, and/or otherwise enhance the shared game play experience.

Figure 2:
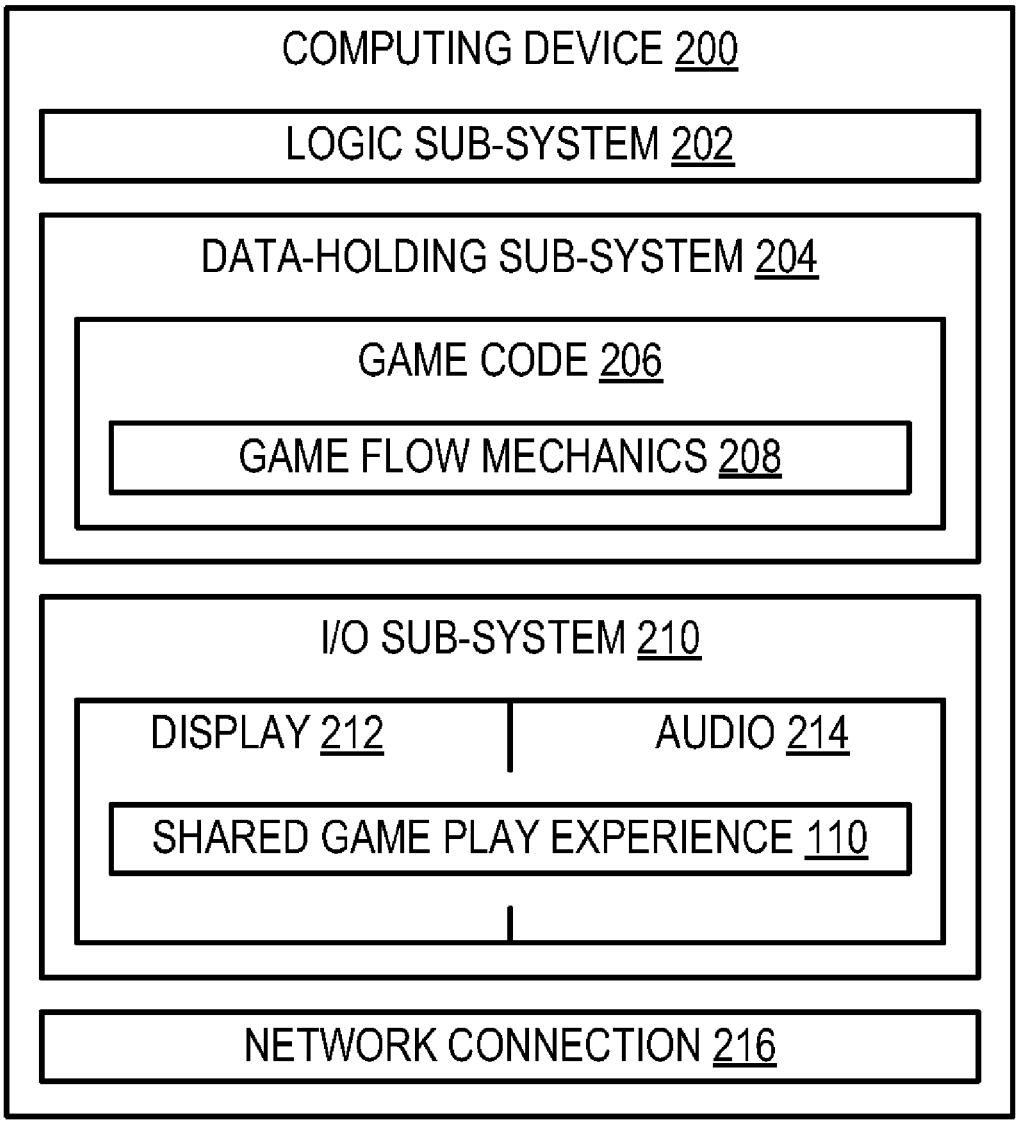
FIG. 2 is a schematic diagram of an embodiment of a computing device that may be implemented in the computing system of FIG. 1.

FIG. 2 is a schematic diagram of an embodiment of a computing device 200. The computing device 200 may be representative of any one of computing devices 102, 104, 106, or 108 shown in FIG. 1. The computing device 200 may perform one or more of the herein described methods and processes. Computing device 200 includes a logic sub-system 202, a data-holding sub-system 204, and a network connection 216. Computing device 200 may include an input/output (I/O) sub-system 210 that may include a display device 212 and an audio device 214 and/or other components not shown in FIG. 2. Furthermore, computing device 200 may be representative of server computing system 114 of FIG. 1, in which case the below described logic sub-system 202 is analogous to logic sub-system 116 of FIG. 1, the below described data-holding sub-system 204 is analogous to data-holding sub-system 118 of FIG. 1, and the below described network connection 216 is analogous to network connection 126 of FIG. 1.

Logic sub-system 202 may include one or more physical devices configured to execute one or more instructions. For example, the logic sub-system may be configured to execute one or more instructions that are part of one or more programs, routines, objects, components, data structures, or other logical constructs. Such instructions may be implemented to perform a task, implement a data type, transform the state of one or more devices, or otherwise arrive at a desired result. The logic sub-system may include one or more processors that are configured to execute software instructions. Additionally or alternatively, the logic sub-system may include one or more hardware or firmware logic machines configured to execute hardware or firmware instructions. The logic sub-system may optionally include individual components that are distributed throughout two or more devices, which may be remotely located in some embodiments.

Data-holding sub-system 204 may include one or more physical devices configured to hold data and/or instructions executable by the logic sub-system to implement the herein described methods and processes. When such methods and processes are implemented, the state of data-holding sub-system 204 may be transformed (e.g., to hold different data). Data-holding sub-system 204 may include removable media and/or built-in devices. Data-holding sub-system 204 may include optical memory devices, semiconductor memory devices, and/or magnetic memory devices, among others. Data-holding sub-system 204 may include devices with one or more of the following characteristics: volatile, nonvolatile, dynamic, static, read/write, read-only, random access, sequential access, location addressable, file addressable, and content addressable. In some embodiments, logic sub-system 202 and data-holding sub-system 204 may be integrated into one or more common devices, such as an application specific integrated circuit or a system on a chip. Data-holding sub-system 204 may include computer-readable removable media, which may be used to store and/or transfer data and/or instructions executable to implement the herein described methods and processes. The above description may also apply to like elements of server computing system 114.

Display device 212 may be used to present a visual representation of data held by data-holding sub-system 204. As the herein described methods and processes change the data held by the data-holding sub-system, and thus transform the state of the data-holding sub-system, the state of display device 212 may likewise be transformed to visually represent changes in the underlying data. Display device 212 may include one or more display devices utilizing virtually any type of technology. Such display devices may be combined with logic sub-system 202 and/or data-holding sub-system 204 in a shared enclosure, or such display devices may be peripheral display devices.

Likewise, audio device 214 may be used to present an audio representation of data held by data-holding sub-system 204. As the herein described methods and processes change the data held by the data-holding sub-system, and thus transform the state of the data-holding sub-system, the state of audio device 214 may likewise be transformed to audibly represent changes in the underlying data.

Continuing with FIG. 2, data-holding sub-system 204 may hold game code 206 that when executed by logic sub-system 202 may generate a single shared game play experience 110 based on game data 124 aggregated by game data aggregation service program 120 shown in FIG. 1. The game code 206 may include game mechanics 208. The game mechanics 208 may include a construct of rules that govern how the game is implemented. The game mechanics 208 may enable the actions or events associated with any one player in a game session to impact and influence the game play experience of a selection of or all other players in that game session since all players concurrently share a single game play experience. In particular, game data 124 may be used by game code 206 to influence, via game mechanics 208, the game play experience for all players in a game session in real-time.

Network connection 216 may be configured to enable two-way communication between different computing devices of the computing system. The network connection 216 may include virtually any suitable software, firmware, and/or hardware that enables computing device 200 to be connected to one or more networks (e.g., the Internet) in order to communicate with one or more computing devices.

Figure 3:
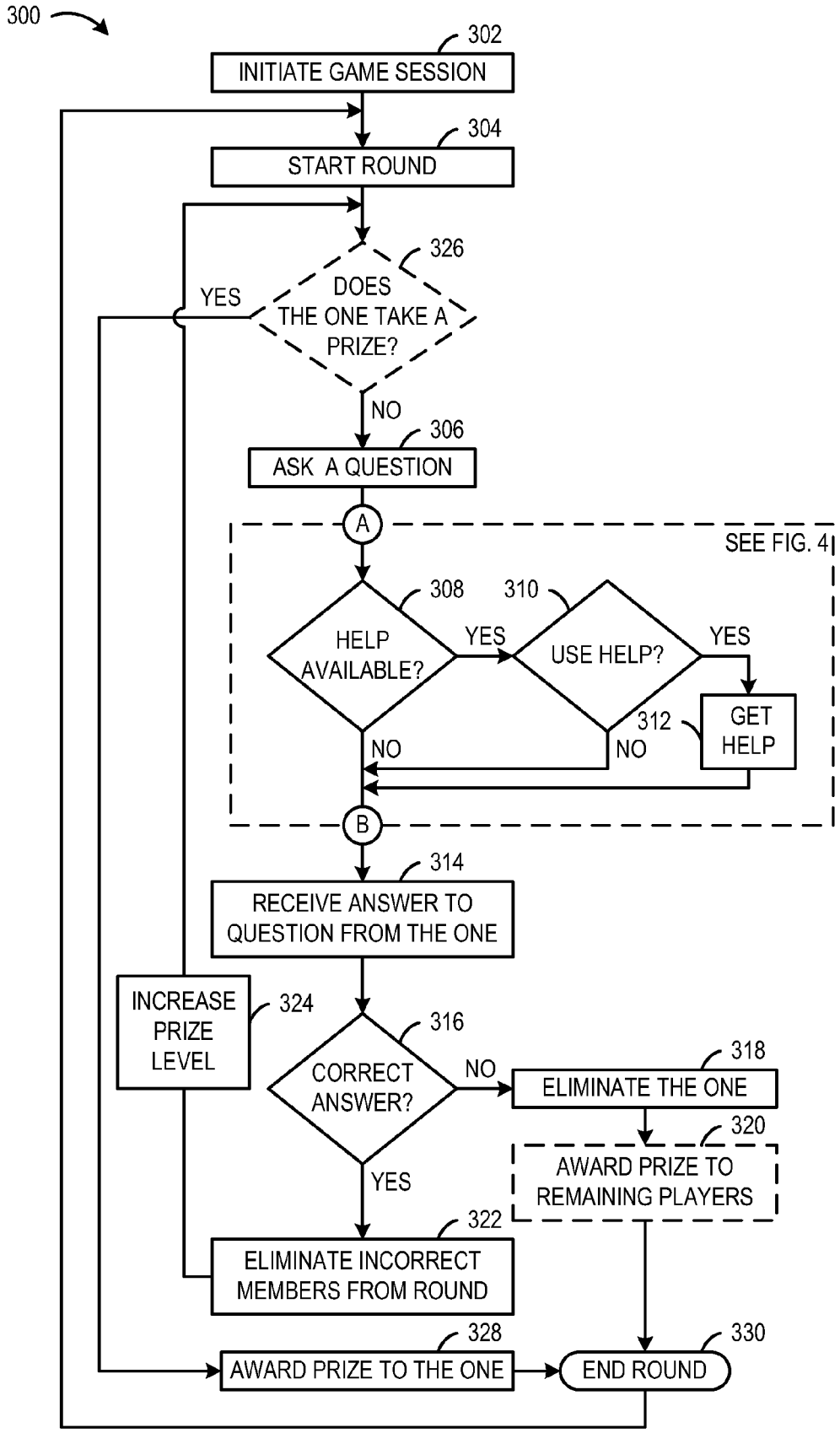
FIG. 3 is a flow diagram showing an embodiment of a game flow for a massively multiplayer game in which the actions of each player affect the game play experience for all other players.

FIG. 3 is a flow diagram showing an embodiment of a method or game flow 300 that may be implemented for massively multiplayer games in which the actions of each player may affect the game play experience for all other players. The massively multiplayer game may be executable by a massive number of computing devices. For example, the massively multiplayer game may be implemented in computing system 100 of FIG. 1. In particular, game data aggregation service program 120 executable by server computing system 114 may be configured to initiate a game session by communicatively linking a player group of remotely located computing devices (between one another directly and/or through a server computing system) via a network. The game data aggregation service may be configured to send event driven requests to each of the remotely located computing devices of the player group, and receive answer responses to the requests from at least some of the remotely located computing devices of the player group. The game data aggregation service may be configured to aggregate the received responses to form game data, and distribute the game data to each of the remotely located computing devices to influence the game flow for each of the players in the player group synchronously in real-time.

Furthermore, the remotely located computing devices (e.g., computing devices 102, 104, 106, 108) each may be configured to execute game code representative of a local game client. The local game client of each computing device may be configured to present a game play experience that is concurrently shared by each player of the player group. In order to maintain synchronization of the shared game play experience between all players of the player group, each local game client may be configured to be event driven. Moreover, the game data aggregation service may be configured to synchronize game play for all of the remotely located computing devices of the player group by distributing the aggregated game data at a predetermined time. In this way, the server and the clients cooperate to create a shared game play experience that is synchronized for all players.

At 302, the method may include initiating a game session including a game play experience concurrently shared by players of the game session. As discussed in the above example, game data aggregation service program 120 may be configured to communicatively link remotely located computing devices of a player group so that game data may be collected, aggregated, and synchronously distributed on a massive scale so that all players may concurrently share a game play experience synchronized in real-time.

In some embodiments, the massively multiplayer game may include a round-based trivia game, such as 1 vs 100, for example. At 304, the method may include beginning a round of the round-based trivia game. When beginning the round, each player may be placed in a category or assigned a role (e.g., The One, The Mob, The Crowd). For example, the game data aggregation service program 120 of FIG. 1 may be configured to assign each remotely located computing device of a player group to one of a plurality of different roles. In some game modes, at least part of the game session may be driven by events associated with The One. For example, events associated with The One may drive progression of a round of the round-based trivia game. In particular, event-driven requests may be sent responsive to events associated with a remotely located computing device of The One. In other words, the actions of The One may impact the game flow of a round. Moreover, the actions of The One may be influenced by other players of the game session.

The round of the game may begin with a question and answer loop where a question may be presented to some or all players in the game session at the same time. At 306, the method may include prompting all of the players in the game session to choose a selection. In some embodiments, prompting may include asking all of the players to select an answer to a trivia question. Further, in the cases where a live host is involved, the live host may ask the trivia question to all of the players.

As an example, the question may be a multiple choice type question having three possible answers. The game data aggregation service may send each player in the game session three possible answers from which each player may select an answer. The game data aggregation service may be configured to receive selected answer responses from the players for a predetermined period of time. After the predetermined period of time, the game data aggregation service may be configured to lock the answers received from at least some of the remotely located computing devices and ignore answers received after the predetermined period of time.

In some embodiments, the massively multiplayer game may include a help option that may be used by The One in order to help answer a trivia question. In some embodiments, The One may use information learned from a help option to decide which answer to select. In some embodiments, The One must use the help answer once they choose the help option.

Figure 4:
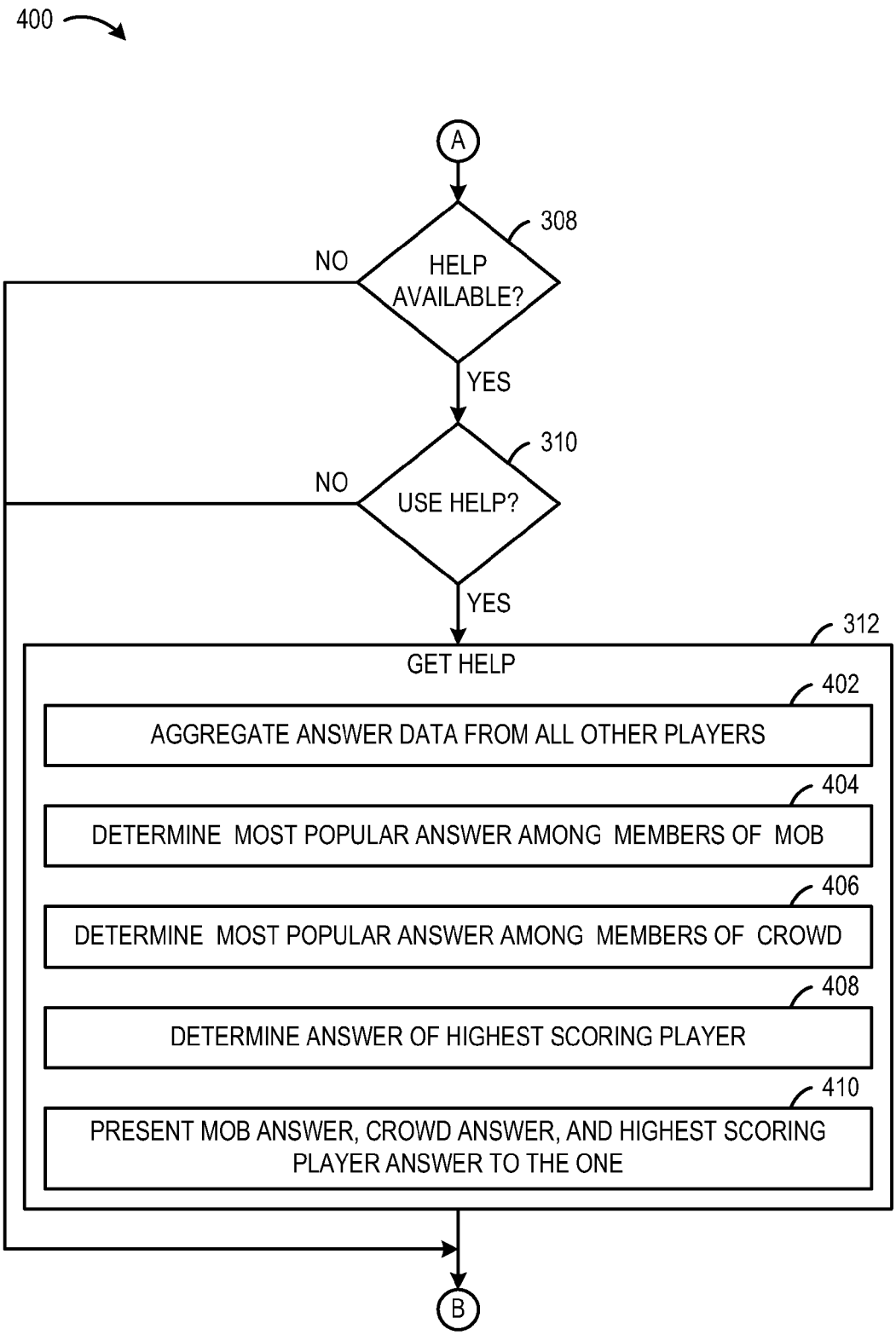
FIG. 4 is a flow diagram of an example help option that may be implemented in the game flow of FIG. 3.

FIG. 4 is a flow diagram of an example help option that may be implemented in the game flow of FIG. 3. At 308, the method may include determining if the help option is available. If the help option is available, the method moves to 310. Otherwise, the help option is not available and the game flow moves to 314. As an example, the help option may not be available because The One may have already used the help option. As another example, the help option may be disabled in some game modes.

In response to the help option being available, the method may include offering the help option to help The One select an answer to the trivia question. Thus, at 310, the method may include determining if The One accepts the help option. If it is determined that The One accepts the help option the method moves to 312. Otherwise, The One does not accept the help option and the method moves to 314. As an example, game data aggregation service program 120 may be configured to send requests to computing device 102 asking if The One wants to use the help option. The computing device 102 may be configured to send responses to the requests communicating whether or not The One wants to use the help option.

In response to receiving acceptance of the help option, at 312, the method may include getting help. This may include prompting all players other than The One to choose a selection (an answer to the trivia question). Upon receiving chosen selections from at least some of the players other than The One, at 402, the method may include aggregating answer data from all of the players that chose a selection. Said another way, upon receiving a chosen selection or selected answer from any one of the players, the chosen selection or selected answer may be aggregated to form the answer data.

At 404, the method may include determining a most popular answer from The Mob based on the aggregated answer data. If The One selects help from the Mob, the most popular answer aggregated for the members of The Mob may be used by The One. In this case, the members of The Mob affect the game play experience of all the players of the game session based on which answer to the question that they select. Further, a player selected as a member of The Mob may adjust game play of other players by affecting the type/level of prize awarded to The One and/or the members of The Mob based on whether the selected answer is correct or incorrect.

At 406, the method may include determining a most popular answer from The Crowd based on the aggregated answer data. If the One selects help from The Crowd, the most popular answer aggregated for the members of The Crowd may be used by The One. In this case, the members of The Crowd affect the game play experience of all the players of the game session based on which answer to the question that they select. Further, a player selected as a member of The Crowd may adjust game play of other players by affecting the type/level of prize awarded to The One and/or the members of The Mob based on whether the selected answer is correct or incorrect.

As an example, game data aggregation service program 120 of FIG. 1 may be configured to aggregate the received responses from remotely located computing devices assigned to The Mob to determine the most popular response of The Mob. Likewise, game data aggregation service program 120 may be configured to aggregate the received responses from remotely located computing devices assigned to The Crowd to determine the most popular response of The Crowd.

At, 408 the method may include determining an answer from the highest scoring player (a.k.a. "The Brain") in the game session. The player having the highest score of the round or game session based on a predetermined scoring metric may be designated as the high score leader or The Brain regardless of their role in the game. In other words, The Brain may be a member of The Mob or a member of The Crowd. In some embodiments, The Brain may also be a subset of players of the player group, such as for example, the top 10 highest scoring players in the current game round. If The One selects help from The Brain, the answer provided by that player may be used by The One. In this case, the player selected as The Brain may affect the game play experience of all the players of the game session based on which answer to the question that they select. Further, the player selected as The Brain may adjust game play of other players by affecting the type/level of prize awarded to The One and/or the members of The Mob based on whether the selected answer is correct or incorrect.

At 410, the method may include presenting the most popular answer of The Mob, the most popular answer of The Crowd, and the answer of The Brain to The One. Further, the method may include prompting The One to select one of the plurality of popular answers to the trivia question. As an example, game data aggregation service program 120 may be configured to send the popular answers to computing device 102 and computing device 102 may be configured to send a selection of one of the popular answers to the game data aggregation service.

The help option described above, may allow a selected answer of a player to be presented to a different player to influence selection of an answer to the trivia question by that different player. Accordingly, the selection of any one player may influence the selection of The One. Further, since at least part of the game session (e.g., a round) is driven by events associated with The One, the selection of any one player may adjust the game play for all of the players in the game session by influencing selection of The One.

Returning to FIG. 3, at 314, the method may include receiving an answer to the trivia question from The One. If The One accepted the help option, the method may include receiving a selected one of the plurality of popular selections of answers to the trivia question from The One. If The One did not accept the help option, the method may include receiving a chosen selection of an answer to the trivia question from The One. Game play for all remotely located computing devices of the player group may be synchronized at a predetermined time based on the selected popular answer received from the remotely located computing device of The One.

At 316, the method may include determining if the answer received from The One is a correct answer to the trivia question. This selection may impact game play for all players in the game session differently based on whether or not the selected answer is correct. If the answer is correct, the method moves to 322. Otherwise, the answer is incorrect and the method moves to 318.

At 318, The One has selected an incorrect answer to the trivia question, so the method may include eliminating The One from eligibility to be awarded a prize. Further, the method may include eliminating all players that select an incorrect answer to the trivia question from eligibility to be awarded a prize.

At 320, the method may include awarding a prize at the current prize level to eligible players that select the correct answer to the trivia question. The prize level may be based on a number of players that select the correct answer or a number of players that select an incorrect answer. For example, the prize may be awarded to the remaining members of The Mob that answered the trivia question correctly. The prize level of the prize may be based on the number of members remaining in The Mob when The One is eliminated.

If the answer to the trivia question selected by The One is correct, at 322, the method may include eliminating all players that select an incorrect answer to the trivia question from being eligible to be awarded a prize. For example, all members of The Mob that answered incorrectly may be eliminated. In some embodiments, the eliminated members may still participate in the round and influence game play even though they are not eligible to be awarded a prize. For example, an eliminated Mob member's selection may still be aggregated to determine a popular answer for The Mob that is presented to The One in the help option.

At 324, the method may include increasing a prize level of a prize to be awarded to all eligible players that select a correct answer to the trivia question. The prize level may be increased based on a number of players that select the correct answer or a number of players that select an incorrect answer. Said another way the prize level may be increased based on the number of players remaining in The Mob or the number of players eliminated from The Mob. In some embodiments, the prize level may be adjusted based on the answer results of each question. In some embodiments, the prize level may be cumulatively adjusted as members of The Mob are eliminated. Next, the method returns to the beginning of the question and answer loop.

At 326, the method may include, prior to asking a different trivia question, offering to award a prize to The One. The prize may be at a first prize level that is lower than a second prize level of an award produced upon selection of a correct answer to the trivia question. The One may choose to take the prize at the current prize level and end the round or may put the prize at risk in order to increase the prize level by successfully answering another trivia question. If The One chooses to be awarded the prize, the method moves to 328. Otherwise, The One chooses to not be awarded the prize at the current prize level and the method continues with the question and answer loop by prompting all of the players to answer a different trivia question.

At 328, the method may include in response to receiving acceptance of the offer to award the prize from The One, awarding the prize to The One at the current prize level, and moving to 330.

At 330, the method may include ending the round of the game. The round may be ended based on a variety of game mechanics that are affected by chosen selections of any of the players of the game session. For example, if The One answers a question incorrectly the round ends. This action may adjust game play for all players, since a new round may be started and each player may be re-categorized into one of the player types (i.e., The One, The Mob, The Crowd). In particular, when a round ends a new player may be selected to be The One and a new group of players may be selected to be the members of The Mob. Note, in some cases, a player may be selected to be The One or a member of The Mob repeatedly from round to round. In some cases, new players may be selected to be The One or a member of The Mob, unless there are no other eligible players who can assume that role.

In some cases, this may further adjust game play for the members of The Mob by deciding the type or level of prize they are awarded. As one particular example, if The One answers a first question in a round incorrectly the members of The Mob may be awarded a low level or small prize, whereas had The One answered the tenth question in a round incorrectly more members of The Mob may have been eliminated and the remaining members of The Mob may be awarded a high level or large prize. As another example, the round may end when all members of The Mob are eliminated by selecting an incorrect answer to a trivia question. As another example, the round may end if The One accepts an offer to be awarded a prize.

As an example, game data aggregation service program 120 of FIG. 1 may be configured to perform actions 314-330.

The above method may be performed to enable a plurality of players to interact in a massively multiplayer game with a concurrently shared single game play experience in real-time where any one player may take action or be involved in an event that impacts and/or influences the game play experience of some or all other players in the game. By permitting any player in the game to influence the game play of all other players in the game on a massive scale, the interest level of a player may be captured for a longer period and the player may derive added enjoyment from playing the game. Thus, the player may play the game more frequently or for a longer period of time.

In the above described game flow, The One is effectively driving the game experience for everyone else through a series of questions, but the One's fate may be decided by the other players if The One uses the help option. In particular, game play for all players may be adjusted based on a popular answer chosen by The One that is determined from answers selected by any one of the players in the game session. Accordingly, game play for all players may be adjusted based on a chosen selection of any one of the players.

Furthermore, game play for some or all players may be adjusted based on a selection or action taken by any one player. For example, the score or type/level of prize awarded to a player may be adjusted based on selections made by another player. As an example, The One may be affected by the number of members remaining in The Mob, which may change based on the actions of the members of The Mob, respectively. Moreover, each player's prize level or score on a question may be impacted by the performance of other players. For example, the number of members of The Mob that are eliminated on an individual question may add a bonus to the score of players that answered the question correctly. This bonus may be applied to the score of The One, the members of The Mob, and the members of The Crowd that answered the question correctly. Accordingly, in this game any player can impact the course of the real-time game flow for all other players in the game session. In other words, the game flow mechanics can use the real-time actions of each individual player (considered alone or as a component of a more inclusive aggregation) to change game play for all players on a massive scale.

As another example, if The One answers a question correctly the round continues. If a member of The Mob answers the question incorrectly they are eliminated from The Mob (or become a non scoring member). This action may affect the game play experience of The One as, well as the remaining members of The Mob, by increasing the scoring and/or type/level of prize distributed at the end of the round.

As another example, if The One selects a prize instead of answering the current trivia question the round ends. This action may affect the game play experience of all players by ending the round in which they are participating. This action may further affect the members of The Mob by deciding the type or level of prize they are awarded. In some cases, the members of The Mob may receive no prize unless The One answers a question incorrectly.

As another example, The One may request help from The Mob, The Crowd, or a selected individual (e.g., "The Brain") to answer a question. When The One accepts help, The One is presented with the most popular answer submitted by The Mob, The Crowd, and the answer that is submitted by The Brain. To implement such a help system with a massively multiplayer game, data from the individual players is collected and aggregated. Thus, a selection of any of the players may contribute to an adjustment in the game play experience of all of the players since all of the players shared a single game play experience.

In another game mode, no player is selected from the group of total players of the game session to act as The One. Instead, all players act as members of The Mob and compete against one another to answer trivia questions in a round. In this game mode, for example, each round may last for a predetermined amount of time (e.g., thirty minutes) with a set number of questions (e.g., 38 questions) which increase in difficulty as the round progresses. In some implementation of this game mode, the game pacing may be faster and there may be no live host involved.

Instead of the help game mechanic used for The One, a skip question mechanic may be implemented for this game mode. The skip question mechanic may allow each member of The Mob to earn skips which can be used to preserve their streak of questions answered correctly which may increase the prize level of a prize that they are eligible to be awarded.

Furthermore, during game play, data aggregation may be used to present real-time statistics to each player. For example, the current top three scorers may be presented to the other players at some point during game play. Further, all players may be presented with some or all players real-time scores at some point during the game to let a player see where that player ranks relative to the other players. By presenting the real-time scores to a player, the player may change their strategy in an attempt to increase their score which may adjust the game play experience of the all of the players.

Other games in which any one player may affect the game play experience of all other players may not include game mechanics that include The One, The Mob, and/or The Crowd.

It is to be understood that the herein described game flow and methods can be used with a variety of different games played by virtually any number of players. However, the herein described game flow and methods may be particularly well suited for massively multiplayer games in which the same game experience is to be shared among a very large number of players in real-time.

It is to be understood that the configurations and/or approaches described herein are exemplary in nature, and that these specific embodiments or examples are not to be considered in a limiting sense, because numerous variations are possible. The specific routines or methods described herein may represent one or more of any number of processing strategies. As such, various acts illustrated may be performed in the sequence illustrated, in other sequences, in parallel, or in some cases omitted. Likewise, the order of the above-described processes may be changed.

The subject matter of the present disclosure includes all novel and nonobvious combinations and subcombinations of the various processes, systems and configurations, and other features, functions, acts, and/or properties disclosed herein, as well as any and all equivalents thereof.

The invention claimed is:

1. A computing system for coordinating massively multiplayer games, comprising:

a network connection configured to enable two-way communication with a player group of at least thousands of remotely located computing devices;

a logic subsystem configured to execute instructions; and a data-holding subsystem holding instructions executable by the logic subsystem to:

send an event-driven request to answer a question to each remotely located computing device of the player group, the event-driven request being sent responsive to events associated with a remotely located computing device of a featured player of the player group that vary in timing based on actions taken by the featured player during a current round of a game;

receive answer responses to the event-driven request from at least some of the remotely located computing devices of the player group;

aggregate received responses to the event-driven request; and synchronize game play to produce a game experience concurrently shared in real-time by all remotely located computing devices of the player group based on aggregated responses received from at least some of the remotely located computing devices of the player group, at a predetermined time, the game experience including a game view and game sounds representative of a virtual setting in which at least a featured group of players of the player group including the featured player and at least one hundred players collectively competing against the featured player are virtually represented to all players of the player group by virtual avatars in the virtual setting for the current round of the game, wherein the featured player and the at least one hundred players are selected for the current round based on player statistics aggregated from game play in one or more previous rounds of the game.

2. The computing system of claim 1, further holding instructions executable by the logic subsystem to:

assign each remotely located computing device from the player group one of a plurality of different roles, a first role being assigned to a first group including at least one hundred remotely located computing devices corresponding to the at least one hundred players.

3. The computing system of claim 2, wherein the plurality of different roles includes a second role that is assigned to a selected remotely located computing device from the player group corresponding to the featured player.

4. The computing system of claim 3, wherein the plurality of different roles includes a third role that is assigned to a third group including all remotely located computing devices in the player group that are not assigned the first role or the second role.

5. The computing system of claim 4, wherein the featured group of players includes all remotely located computing devices assigned to the first role and the second role.

6. The computing system of claim 1, wherein the question is a trivia question of a massively multiplayer round-based trivia game.

7. A method for implementing a massively multiplayer game executable by a massive number of computing devices, the method comprising:

initiating a game session for a player group of at least thousands of remotely located computing devices, the game session including a game experience concurrently shared by all players of the player group, the game experience including a game view and game sounds representative of a virtual setting in which at least a featured group of players of the player group including a featured player and at least one hundred players collectively competing against the featured player are virtually represented to all players of the player group by virtual avatars in the virtual setting for a current round of the game session, wherein the featured player and the at least one hundred players are selected for the current round based on player statistics aggregated from game play in one or more previous rounds of the game session or one or more previous game sessions;

sending an event-driven request to answer a question to each remotely located computing device of the player group, the event-driven request being sent responsive to events associated with a remotely located computing device of the featured player of the player group that vary in timing based on actions taken by the featured player during the current round of the game session;

receiving answer responses to the event-driven request from at least some of the remotely located computing devices of the player group;

aggregating received responses to the event-driven request; and synchronizing game play for all remotely located computing devices of the player group based on aggregated responses received from at least some of the remotely located computing devices of the player group, at a predetermined time.

8. The method of claim 7, wherein the massively multiplayer game is a round-based trivia game, the question is a trivia question, and the answer responses are selected answers to the trivia question.

9. The method of claim 8, wherein events associated with the featured player of the featured group of players drive progression of the current round of the round-based trivia game.

10. The method of claim 9, further comprising:

sending popular answer responses to the remotely located computing device of the featured player, the popular answer responses being based on the aggregated responses;

receiving a selected popular answer from the remotely located computing device of the featured player;

synchronizing game play for all remotely located computing devices of the player group based on the selected popular answer received from the remotely located computing device of the featured player, at a predetermined time.

11. The method of claim 10, wherein the popular answer responses include a first answer that is a most popular answer aggregated from answer responses received from remotely located computing devices assigned to a first role, a second answer that is a most popular answer aggregated from answer responses received from remotely located computing devices assigned to a second role, and a third answer that is received from a remotely located computing device of a highest scoring player of the player group in the game session.

12. The method of claim 10, wherein the selected popular answer is a correct answer to the trivia question, synchronizing includes increasing a prize level of a prize to be awarded to all featured players that select the correct answer to the trivia question and eliminating all featured players that select an incorrect answer to the trivia question from being eligible to be awarded the prize, the prize level being increased based on a number of featured players that select the correct answer or a number of featured players that select an incorrect answer.

13. The method of claim 10, wherein the selected popular answer is an incorrect answer to the trivia question, synchronizing includes eliminating the featured player from eligibility to be awarded a prize and awarding the prize to all featured players that select a correct answer to the trivia question, the prize being at a prize level based on a number of featured players that select the correct answer or a number of featured players that select an incorrect answer.

14. The method of claim 7, wherein synchronizing game play includes one or more of ending the current round of the game session, adjusting a prize level of one or more players of the player group, awarding a prize to one or more players of the player group, and eliminating one or more players from being eligible to be awarded a prize.

15. A method for implementing game play for a massively multiplayer game executable by a massive number of computing devices, the method comprising:

initiating a game session of a round-based trivia game for a player group of at least thousands of remotely located computing devices, the game session including a shared game experience that includes a game view and game sounds representative of a virtual setting in which at least a featured group of players of the player group including a featured player and at least one hundred players collectively competing against the featured player are virtually represented to all players of the player group by virtual avatars in the virtual setting for a current round of the game session, wherein the featured player and the at least one hundred players are selected for the current round based on player statistics aggregated from game play in one or more previous rounds of the game session or one or more previous game sessions, for the current round of the round-based trivia game, assigning each remotely located computing device from the player group one of a plurality of different roles, a first role being assigned to a first group including at least one hundred remotely located computing devices of the at least one hundred players, a second role being assigned to a selected remotely located computing device of the featured player from the player group, and a third role being assigned to a group including all remotely located computing devices in the player group that are not assigned the first role or the second role, and displaying virtual avatars representing each player assigned to the first role or the second role in the game view on each one of the remotely located computing devices of the player group;

prompting all players of the game session to select an answer to a trivia question;

receiving selected answers from at least some players other than the featured player;

in response to a help option being available to the featured player, offering the help option to help the featured player select an answer to the trivia question;

in response to receiving acceptance of the help option, prompting the featured player to select one of a plurality of popular answers to the trivia question, the plurality of popular answers being determined from the selected answers received from at least some players other than the featured player;

receiving a selected one of the popular answers from the featured player;

if the selected one of the popular answers is a correct answer to the trivia question, eliminating players that select an incorrect answer to the trivia question from eligibility to be awarded a prize in the current round and increasing a prize level of a prize to be awarded to players that select the correct answer to the trivia question, the prize level being increased based on a number of players that select the correct answer or a number of players that select an incorrect answer; and if the selected one of the popular answers is an incorrect answer to the trivia question, eliminating all players that select an incorrect answer to the trivia question from eligibility to be awarded a prize in the current round, and awarding a prize at a current prize level to eligible players that select the correct answer to the trivia question.

16. The method of claim 15, wherein the popular answers presented in the help option include a first answer that is a most popular answer received from remotely located computing devices assigned the first role, a second answer that is a most popular answer received from remotely located computing devices assigned the third role, and a third answer that is selected from a highest scoring player in the game session.

17. The method of claim 15, further comprising:

in response to the featured player selecting the correct answer to the trivia question and prior to prompting all players of the game session to select an answer to a different trivia question, offering to award a prize to the featured player, the prize being at a first prize level that is lower than a second prize level of an award produced upon selection of a correct answer to the different trivia question; and in response to receiving acceptance of an offer to award the prize, awarding the prize to the featured player.

* * * * *